United States Patent [19]

Hajek

[11] Patent Number: 4,808,432

[45] Date of Patent: Feb. 28, 1989

[54] ELECTROSTATIC COATING APPARATUS AND METHOD

[75] Inventor: Bedrich Hajek, New Haven, Conn.

[73] Assignee: Electrostatic Technology Incorporated, New Haven, Conn.

[21] Appl. No.: 897,624

[22] Filed: Aug. 18, 1986

[51] Int. Cl.[4] ..... B05D 1/06

[52] U.S. Cl. ..... 427/32; 427/27; 118/309; 118/630; 118/634

[58] Field of Search ..... 427/27, 32, 185; 118/621, 627, 629, 309, DIG. 5, 630, 634

[56] References Cited

U.S. PATENT DOCUMENTS

| | | | |
|---|---|---|---|
| 2,421,787 | 6/1947 | Helmuth | 117/93 |
| 2,777,784 | 1/1957 | Miller | 117/93 |
| 3,108,022 | 10/1963 | Church . | |
| 3,155,545 | 11/1964 | Rocks et al. | 118/621 |
| 3,248,253 | 4/1966 | Barford et al. | 117/17 |
| 3,326,182 | 6/1967 | Inoue | 118/629 |
| 3,396,699 | 8/1968 | Beebe et al. | 118/634 |
| 3,439,649 | 4/1969 | Probst et al. | 118/634 |
| 3,476,081 | 11/1969 | Facer et al. | 118/620 |
| 3,566,833 | 3/1971 | Beebe | 118/634 |
| 3,607,998 | 9/1971 | Goodridge | 264/24 |
| 3,828,729 | 8/1974 | Goodridge | 118/634 |
| 3,834,927 | 9/1974 | Putney | 117/21 |
| 3,871,328 | 3/1975 | English | 118/630 X |
| 3,916,826 | 11/1975 | Knudsen | 118/629 |
| 4,011,832 | 3/1977 | Westervelt et al. | 118/301 |
| 4,030,446 | 6/1977 | Karr | 118/654 |
| 4,034,703 | 7/1977 | Scheiber et al. | 118/35 |
| 4,051,809 | 10/1977 | Zickar et al. | 118/630 |
| 4,084,019 | 4/1978 | Christ et al. | 427/32 |
| 4,297,386 | 10/1981 | Gillette | 427/27 |
| 4,329,377 | 5/1982 | Voelker et al. | 427/9 |
| 4,330,567 | 5/1982 | Gillette | 427/32 |
| 4,332,835 | 6/1982 | Knudsen | 427/32 |
| 4,418,642 | 12/1983 | Gillette et al. | 118/624 |
| 4,472,452 | 9/1984 | Gillette et al. | 427/32 |
| 4,517,219 | 5/1985 | Hajek | 427/8 |
| 4,526,804 | 7/1985 | Escallon | 427/32 |
| 4,606,928 | 8/1986 | Dunford et al. | 427/32 |

*Primary Examiner*—Shrive Beck
*Assistant Examiner*—Alain Bashore
*Attorney, Agent, or Firm*—Ira S. Dorman

[57] ABSTRACT

An electrostatic powder coating unit utilizes a tubular cloud of charged particles moving helically within a generally cylindrical porous member, for coating workpieces conveyed therethrough. The electrode assembly, by which ionized air is produced for charging the particles, may be mounted to rotate about the cylindrical porous member, for optimal efficiency and effectiveness.

24 Claims, 4 Drawing Sheets

ELECTROSTATIC COATING APPARATUS AND METHOD

BACKGROUND OF THE INVENTION

A technique that is now widely used for insulating electrical conductors such as wires, and for producing coatings for other purposes and on various substrates, entails the exposure of the grounded workpiece to a cloud of electrostatically charged particles, thereby causing the particles to deposit thereupon for subsequent integration. Typical equipment used for that purpose is disclosed and claimed in the following U.S. Pat. Nos. 3,828,729 to Goodridge, 3,916,826 to Knudsen, 4,030,446 to Karr, 4,297,386 and 4,330,567 to Gillette, 4,332,835 to Knudsen, 4,418,642 and 4,472,452 to Gillette et al, and 4,517,219 to Hajek. Electrostatic fluidized bed apparatus and systems that are highly effective for such coating are commercially available from the common assignee of those patents and of the instant application, Electrostatic Technology Incorporated, of New Haven, Conn.

Dunford et al application Ser. No. 708,989, which will issue on Aug. 19, 1986 as U.S. Pat. No. 4,606,928 and is also of common assignment herewith, discloses and claims a method, apparatus, and system by which workpieces, and particularly conductors of continuous length, can be coated by electrostatic powder deposition, quickly, efficiently, safely, and with an exceptionally high degree of uniformity in the build. As is true of other electrostatic fluidized bed coating equipment, that of the Dunford et al patent employs a planar porous plate above which a cloud of charged particles is produced. In accordance therewith, however, a secondary, generally tubular cloud of charged particles is produced within the primary cloud, from which the particles move radially to coat the workpiece as it is conveyed therethrough.

Despite the highly desirable results that are achieved by use of the Dunford et al invention, as well as by use of certain of the other prior art methods and apparatus, a number of disadvantages are inherent therein. For example, such units tend to be relatively large, and to require a considerable volume of coating powder for proper operation; this in turn means that a relatively large capacity recovery and dust collection subsystem must be employed. The coating material within the coating chamber of such a unit must not only be kept at a fairly constant level during operation (necessitating the provision of a level control arrangement), but it must also be removed at night or during other similar periods of nonuse, to avoid moisture pick-up problems.

In addition, even though measures may be taken to design the apparatus so as to minimize the presence of structure from which collected powder can drop upon the workpiece, and thereby produce flaws in the coating, as a practical matter it is not feasible to eliminate such surfaces entirely. And finally, despite the substantial decreases in voltage requirements enabled by the equipment of the above-mentioned patents, with the concomitant energy savings and enhancements of safety that result, further power reductions would of course be of great benefit.

Accordingly, it is a broad object of the present invention to provide a novel method, apparatus, and system by which workpieces, and particularly conductors of continuous length, can be coated by electrostatic powder deposition, quickly, efficiently, safely, and with an exceptionally high degree of uniformity in the build.

A more specific object of the invention is to provide such a method, apparatus and system in which the coating unit is smaller than prior art apparatus of comparable effectiveness and efficiency, requires less coating powder and a recovery system which is of correspondingly reduced capacity, obviates any need for powder bed level control, and avoids any tendency for powder buildup on surfaces over the workpiece travel path.

It is also an object of the invention to provide such a method, apparatus and system wherein coating can be carried out at voltage levels that are significantly reduced from those heretofore employed for practical high-speed operation, thereby further enhancing safety.

Another object of the invention is to provide such a novel method, apparatus and system wherein the nature of the coating can readily be controlled by the speed of the workpiece and the magnitude of the voltage applied, is highly tolerant of changes of workpiece position within the cloud of charged particles, and is virtually unaffected by normal fugitive electrical effects, such as noise and static.

Still another object of the invention is to provide such a method, apparatus and system wherein economy of production is maximized by the significant reduction of waste produced during start-up and discontinuances of operation.

A still further object of the invention is to provide a novel coating unit which is relatively uncomplicated and inexpensive to manufacture and operate.

SUMMARY OF THE INVENTION

It has now been found that certain of the foregoing and related objects of the invention are attained by the provision of electrostatic coating apparatus comprised of chamber-defining structure, and a generally cylindrical porous member disposed therewithin. The cylindrical member is adapted to permit gas flow from the plenum, which is cooperatively formed with the chamber-defining structure, to its interior, generally over substantially its entire length and circumference. Also provided are means for creating a helical flow of a gaseous suspension of particulate coating material within, and substantially coaxially with, the cylindrical member, and for electrostatically charging the same. As a result, a generally tubular cloud of charged particles, flowing along a generally helical path, can be produced within the cylindrical member for coating of a workpiece conveyed along a travel path axially therethrough and maintained at an effectively opposite electrical potential.

In the preferred embodiments, the charging means of the apparatus will comprise at least one electrode member, which will usually be elongated, and means will be provided for supporting the electrode member within the plenum, normally generally parallel to the axis of the cylindrical member. In such apparatus, the supporting means will most desirably be rotatably mounted and adapted to permit the electrode member to move along a circular path about the cylindrical member. Generally, the chamber-defining structure will include means for admitting a gas into the plenum for ionization by contact with the electrode member; in such instances, the supporting means for the electrode member may include a vane member, with the gas-admitting means serving to direct a stream of gas thereagainst to effect such rotation.

Other objects of the invention are attained by the provision of an electrostatic powder coating system which includes, in addition to coating apparatus as herein described, means for continuously conveying a workpiece along the travel path therethrough. Generally, the conveying means will be adapted to convey metal conductors of continuous length.

Additional objects are attained by the provision of a coating method, wherein a generally cylindrical volume of moving gas is created in which mass transfer in substantially limited to radially inward flow. A helical flow of gas-suspended particles is also created, so as to produce a generally tubular cloud thereof coaxially with and within the cylindrical volume of gas, and the particles are electrostatically charged. By conveying a workpiece along a path substantially on the common axis of the cylindrical volume of gas and the cloud, and at an electrical potential that is effectively opposite to the charge on the particles, the latter will be electrostatically attracted to the workpiece so as to produce a deposit thereupon. Preferably, a rotatably mounted electrode component will be employed to produce an ionized gas for charging of the particulate material, and most desirably the same supply of gas that is used to create the cylindrical volume and for electrostatic charging of the particles will also be employed for pneumatically driving the mounting means for the electrode component.

DETAILED DESCRIPTION OF THE ILLUSTRATED EMBODIMENTS

Figure 2:
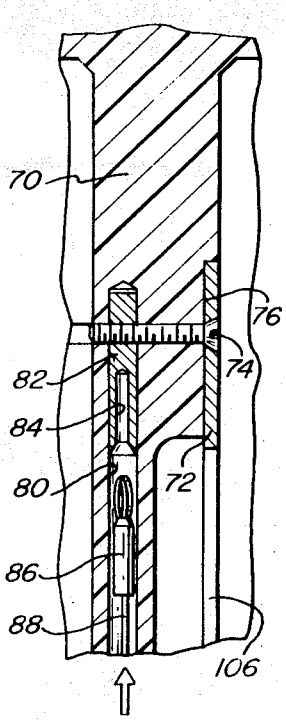
FIG. 2 is a fragmentary view showing components of the apparatus of FIG. 1 used for conducting electrical power to the electrode components thereof, taken along line 2—2 of FIG. 3 and drawn to a greatly enlarged scale.
Figure 1:
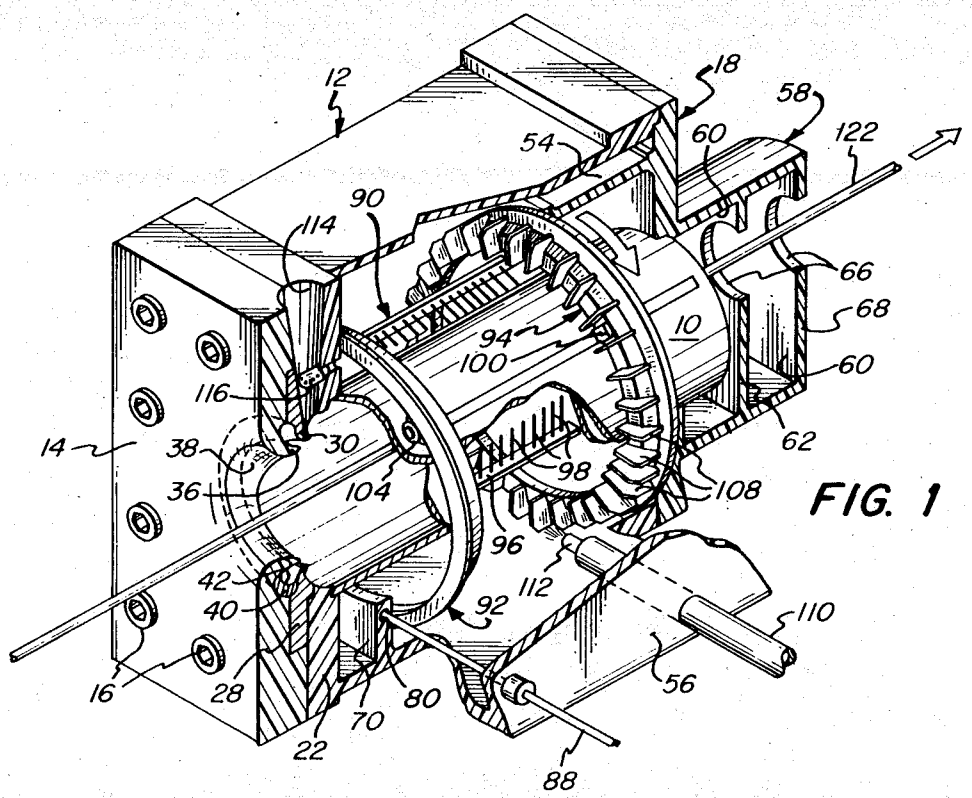
FIG. 1 is a fragmentary perspective view of coating apparatus embodying the present invention, showing a section of a continuous length of wire being conveyed axially therethrough.
Figure 3:
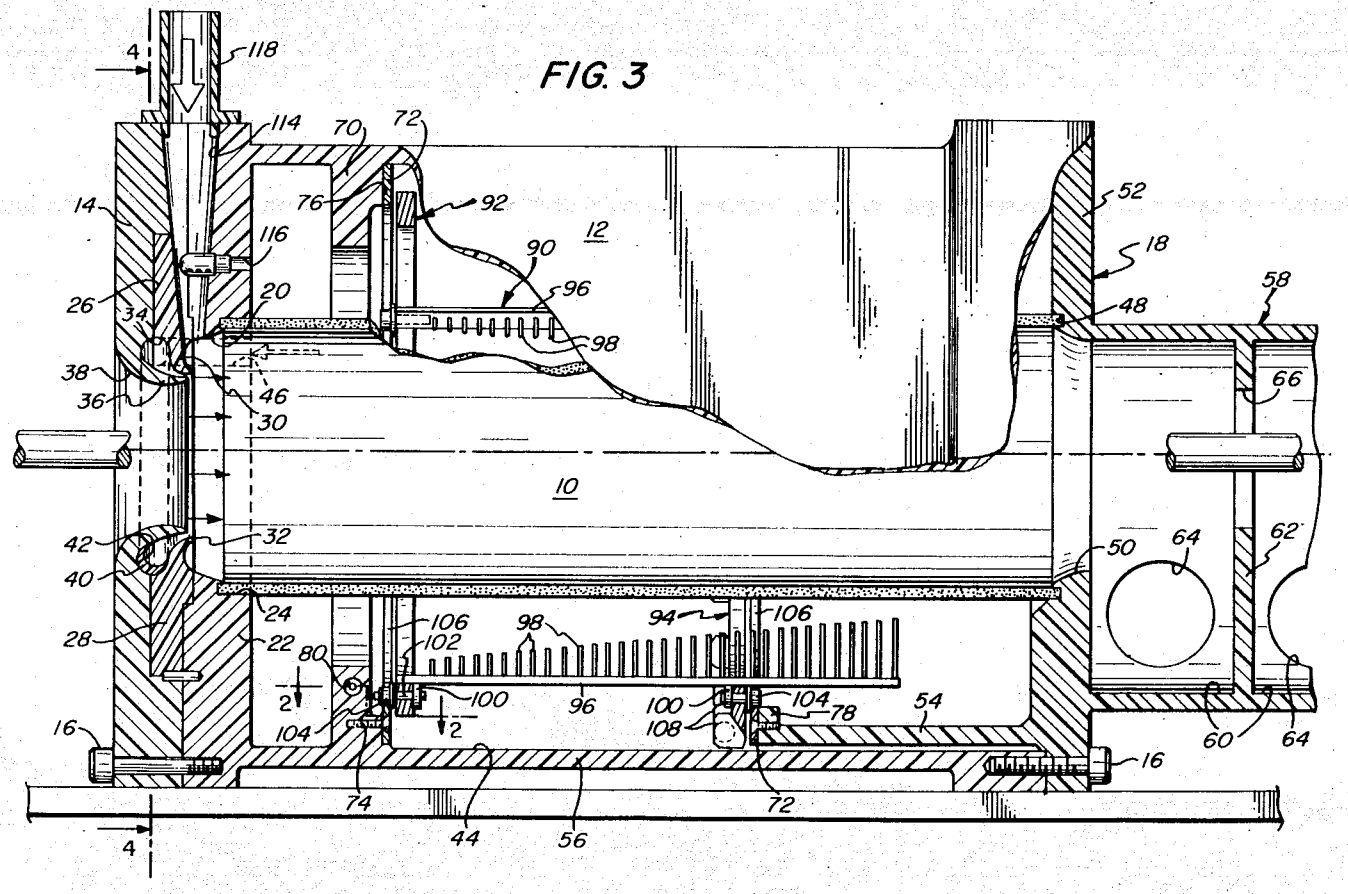
FIG. 3 is a fragmentary view of the apparatus of FIG. 1, drawn to an enlarged scale, in partial vertical section and with portions broken away.

Turning now in detail to FIGS. 1–5 of the appended drawings, therein illustrated is an electrostatic coating unit embodying the present invention, consisting of a housing assembly within which is supported a porous cylindrical member, generally designated by the numeral 10. The housing consists of a central section, generally designated by the numeral 12, having at its inlet end an end plate 14, secured by screws 16; an outlet section, generally designated by the numeral 18, is similarly secured at the opposite end of Section 12. A circular inlet opening 20 is formed through the end wall 22 of the central housing section 12, and is surrounded by an annular groove 24 within which one end of the cylindrical porous member 10 is seated. A recess 26 is formed into the inner surface of the end plate 14 and serves to seat an inset piece 28. The latter has an inwardly curled, circumferential lip element 30, which defines and surrounds a central aperture 32 through the piece 28, and which merges into a circumferential groove 34, of generally semicircular cross-section, which is formed into the outer face thereof.

Figure 4:
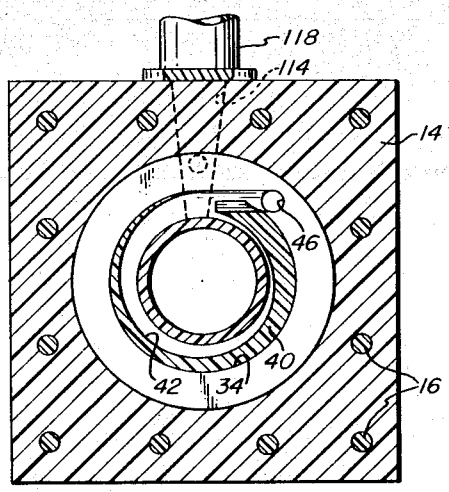
FIG. 4 is a sectional view of the apparatus at the inlet end, taken along line 4—4 of FIG. 3 and drawn to a reduced scale.

The end plate 14 has a similar, inwardly curled circumferential lip element 36 thereon, which surrounds and defines the central aperture 38 therethrough. The lip element 36 cooperates with element 30 and the circumferential groove 34 to define a passageway of generally circular cross-section, which opens through a narrow circular gap defined between the lip elements 30, 36. An insert 40 is seated within the passageway formed between the end plate 14 and the inset piece 28, and is circumferentially tapered (as best seen in FIG. 4) so as to define a complementarily tapered flow passage 42. The latter communicates with the chamber space 44 within the central housing section 12 through a duct 46, which extends through the end wall 22.

The opposite end of the cylindrical member 10 is supported by seating it within a similar annular groove 48, which surrounds the opening 50 formed through the end wall 52 of the outlet section 18. A wall portion 54 extends axially inwardly from the end wall 52, and is telescopically received within the wall portion 56 of the central housing section 12. Consequentially, it cooperates therewith to define the internal chamber space 44 of the housing assembly, which provides a plenum about the cylindrical porous member 10.

Figure 5:
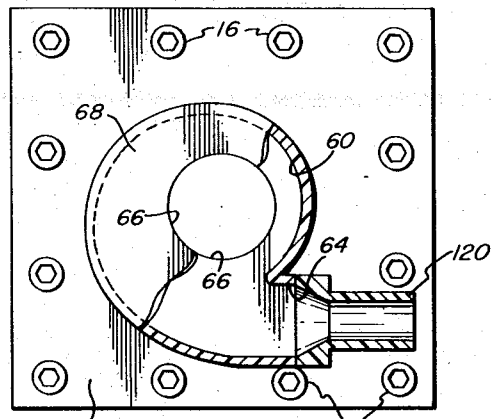
FIG. 5 is a view of the apparatus from the outlet end, drawn to the scale of FIG. 4 and in partial section.

Structure extending from the opposite side of the wall portion 52 of the housing section 18 provides an exhaust chamber, generally designated by the numeral 58, which is divided into two internal, substantially identical compartments 60 by a partitioning wall 62. As is best seen in FIG. 5, the chamber structure is such as to define a cross-sectional configuration for the compartments 60 which is of progressively enlarged dimensions toward the outlet ports 64, with respect to the openings 66 through the partitioning wall 62 and the end wall 68 of the chamber.

An annular rib 70 is formed within the central section 12 of the housing assembly, and it has an annular track component 72 secured, by screws 74, against an inside surface portion 76. A similar track component 72 is attached to flange elements 78 formed about the inner periphery of the wall portion 54 of the housing section 58. A circular bore 80 extends through the outer wall 56 of the central section 12 and within the annular rib structure 70; at its inner end is disposed a receptacle component 82 which defines an elongated socket 84. The socket is adapted to frictionally engage the plug 86 on the end of the cable 88 (attached to a power supply, not shown), so as to enable electrical connection to the track component 72 through the screw 74.

An electrode assembly is disposed within the plenum of the coating unit, about the cylindrical porous member 10, and consists of a number of electrode components, generally designated by the numeral 90 (although three are shown, more or fewer may be found desirable under certain circumstances), which are supported by ring members, generally designated by the numerals 92 and 94. Each elecrode component 90 consists of a bar 96, from the inner surface of which projects a line of needles or pins 98. A pair of tabs 100 project from the outer surface of each bar and receive fastener elements 102, by which they are attached to the ring members 92, 94. A flanged wheel 104 is secured to the outer end of each of the fastener elements 102, and is rotatable thereon and upon the inner edge 106 of the associated track component 72. In this manner, the electrode components 90 are assembled with the ring members 92 and 94 to provide an electrode assembly which is rotatable, on the track components 72, about the cylindrical member 10.

Whereas the ring member 92 is of relatively simple construction, member 94 is more complex in that it mounts an array of vane elements 108. A conduit 110 (from an air supply, not shown) extends through the wall 56 and terminates in a nozzle 112; the latter is disposed adjacent the inner side of the ring member 94, upon which the vane elements 108 are mounted, and extends generally tangentially thereto. Thus, air flowing through the conduit 110 will impinge upon the vane elements 108, thereby providing the motive force for driving the electrode assembly so as to rotate it in the direction indicated by the arrow in FIG. 1.

In operation, high voltage electrical power is supplied to the electrode components 90 through the cable 88, all of the intervening and contacting parts being fabricated of an electrically conductive material. Pressurized air introduced through the conduit 110 not only causes the cage-like electrode assembly to rotate, as described, but the air also becomes ionized by contact with the electrode components. As is well known in the art, the efficiency of ionization is maximized by contact of the air with the pointed end of the needles 98; the desirability of utilizing elements of increasing radial lengths in the downstream direction of the coating path, as illustrated, has also been recognized previously (see the above-identified Dunford et al patent).

Coating powder is introduced into the apparatus through the tapered throat 114 that is formed between the end wall 22 of the housing section 12 and the plate 14 and inset piece 28 secured thereto. A duct 116 is formed through the wall 22, and establishes communication between the throat 114 and the plenum provided by the chamber space 44 within the housing; consequently, the same air that is introduced through the conduit 110 flows into the throat 114 and assists in delivering the powder, which is supplied thereto through the inlet fixture 118, as indicated by the arrow in FIG. 3.

As will be appreciated, air from the plenum also passes through the duct 46 into the flow passage 42 formed by the wall 14, the piece 28 and the insert 40, and it will circulate therethrough and pass outwardly through the circular gap formed between the lip elements 30 and 36; the decreasing cross-section of the passageway serves of course to maintain a substantially constant exit velocity, and thereby to promote uniform flow.

Figure 8:
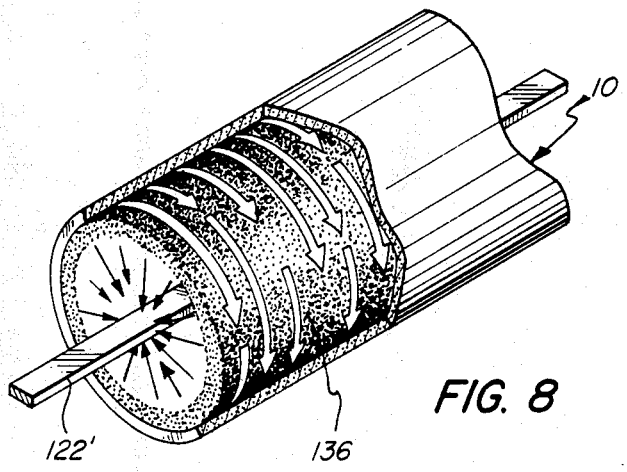
FIG. 8 is a fragmentary perspective view, in partial section, of the porous cylindrical member employed in the coating unit of the invention, diagrammatically suggesting the tubular cloud of helically moving charged particles, and the radial attraction thereof to a rectangular conductor being conveyed therethrough.

Because of the configuration of the parts, the air issuing will proceed along a helical, vortex-like path. It will pick up the particulate coating material 136 passing from the adjacent outlet end of the throat 114, and will thereby produce a cloud of particles of generally tubular configuration, moving along a helical path; the general form of the cloud is indicated in FIG. 8, although it will be appreciated than less distinct boundaries, thickness variation, and the like may exist in practice.

The cloud exits from the cylindrical member 10 through the opening 50 in the end wall 52, and suitable fans or blowers (not illustrated), attached to coupling fixtures 120 at the outlet ports 64 of the exhaust chamber 58, assist such movement. As will be appreciated, the convolute configuration of the compartments 60 within the chamber 58 will cooperate with the vortex structure at the inlet end to promote the desired helical flow of the gaseous suspension of particles, the induced swirling action being in the same direction at both locations.

In addition to serving its other functions, the air introduced through the nozzle 112 also flows through the pores of the cylindrical member 10. In doing so, it forms what may be referred to as a generally cylindrical "volume" of moving gas (notwithstanding that the gas streams in the pores, of which the gas volume is comprised, are not integrated), in which mass transfer is substantially limited to radial inward flow. Not only does this gaseous flow ensure that no deposit of coating material particles will form on the interior surfaces of the cylindrical member, but it is also believed to contribute to the fluidized state of the powder. Because of the former effect, no clumps of powder can form above the workpiece travel path, which would otherwise tend to accumulate and fall upon the wire 122, thereby producing flaws in its coating.

The powder is charged by the ionized air, produced by contact with the needles 98 of the electrode components, as described. Electrostatic charge may in turn be transferred from the air to the powder particles within the throat 114, or upon contact of the powder with the air issuing from the vortex structure at the inlet of the unit, and/or within the cylindrical member 10. In any event, the particles are attracted to and deposited upon the wire workpiece 122 as it moves therethrough (in the direction indicated by the arrow), the wire of course normally being grounded for that purpose.

Figure 6:
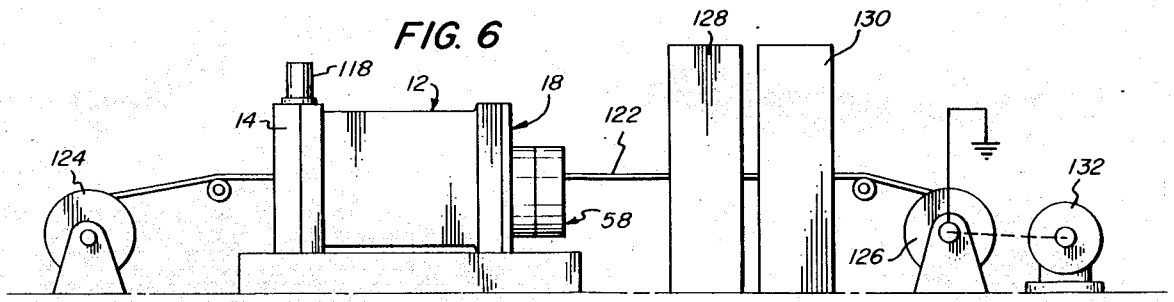
FIG. 6 is a diagrammatic representation of a system embodying the present invention.

Turning now to FIG. 6 of the drawings, a typical eleotrostatic coating system embodying the present invention is diagrammatically illustrated and consists, in addition to a coating unit as previously described, of wire pay-off and take-up mechanisms 124, 126, respectively, for conveying the wire 122 horizontally therethrough, heating and cooling units 128, 130, and a motor 132 for driving the take-up mechanism 126; as will be noted, the latter is grounded. It will be appreciated that a system embodying the invention will normally include other features and subsystems as well, including a powder supply and circulation subsystem, wire cleaning devices, control mechanisms and electronics, and the like.

Figure 7:
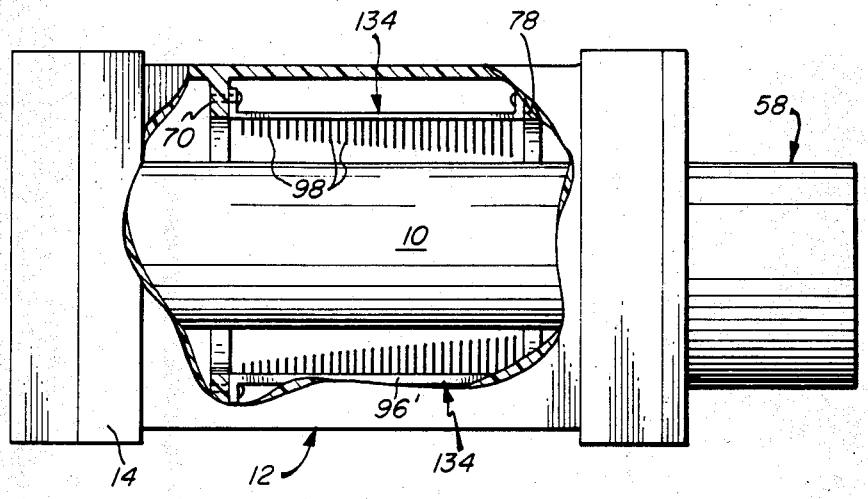
FIG. 7 is an elevational view of a second form of apparatus embodying the invention, with a portion of the chamber-defining housing broken away to expose internal parts.

A second embodiment of the coating unit of the invention is illustrated in FIG. 7, and is virtually the same as that hereinabove described with the exception that the electrode components, generally designated by the numeral 134, are stationary rather than being mounted for rotation. Thus, the bars 96' are simply affixed to the rib 70 and flange elements 78, to remain in preselected locations about the cylindrical member 10. Although it is believed that a rotating electrode assembly may afford better efficiency of charging, and will avoid excess metal within the unit (which can create undue capacitance and thereby affect the uniformity of the coating), the use of fixed electrode components represents a practical alternative which may be preferred in certain circumstances.

Finally, with reference again to FIG. 8, it will be noted that the workpiece 122' is a conductor of rectangular cross-section. Coating uniformity is particularly difficult to achieve upon such a substrate utilizing prior electrostatic fluidized bed coating techniques; this is attributable primarily to density variations in the powder cloud, and to the presence of the sharp edges on the wire. The instant invention obviates those difficulties due, in large measure, to the radial movement of the particles from the cloud to the workpiece, as indicated in the Figure. This and other advantages of the tubular cloud form are discussed more fully in the Dunford et al patent, previously referred to.

In addition, however, the present invention avoids the need for any supply of powder to be maintained within the apparatus, as has heretofore been necessary with electrostatic fluidized bed coating equipment. This not only minimizes the amount of powder that must be maintained within the system, and thereby permits the use of a lower capacity powder recovery system and dust collector, but it also avoids the need for any leveling device to maintain a bed of particles at a proper depth for satisfactory operation. Moreover, units in which a reservoir of powder is maintained must be emptied out during periods of nonuse (such as overnight), so as to avoid moisture-associated problems.

A particular benefit of the present apparatus resides in the fact that there is no opportunity for powder to build up on surfaces adjacent the travel path for the workpiece, as discussed above, and further advantages concern efficiency and safety of operation. Because of the physical relationship of the parts, the electrode components may be disposed in close proximity to the workpiece without arcing; consequently, high levels of efficiency are possible at reduced voltages. Furthermore, there is minimal risk to personnel, since the electrodes are not exposed. The units of the invention may be operated at electrode potentials of 20 to 30 kilovolts, as contrasted with prior art apparatus which has, in the best case, typically required at least 40 to 50 kilovolts for optimal operation, and generally much higher voltage levels were necessary.

Finally, a substantial advantage of the units of the invention resides in their relatively small size and cost of manufacture. Outside dimensions of existing equipment may typically be five to six feet long, four feet high, and one foot wide; on the other hand, the present apparatus may suitably be only three feet long and one and one-half feet square.

Except for the metal electrical components, the coating apparatus may be made virtually entirely of nonconducting synthetic polymers, and this includes the porous cylindrical member (which may be fabricated from the same materials as have heretofore been used for the porous plates of fluidized bed units). It will be understood that many variations are possible in the configuration and construction of the housing, the electrode assembly, and the other parts and components of the apparatus and the system, without departing from the concepts of the present invention. For example, the powder feed system employed may be specifically designed to provide a highly consistent flow rate, for optimal results.

In its broadest sense, the invention contemplates apparatus in which a tubular cloud of charged particles flows helically through a generally cylindrical member, whether porous or not; it is believed that such apparatus has not existed heretofore, and that the vortex creating structure described herein will produce the necessary tubular cloud. However, the use of a porous member, and the other features described herein, achieve optimal results and are of course preferred.

Thus, it can be seen that the invention provides a novel and improved method, apparatus, and system by which workpieces, and particularly conductors of continuous length, can be coated by electrostatic powder deposition, quickly, efficiently, safely, and with an exceptionally high degree of uniformity in the build. The coating unit is smaller than prior art apparatus of comparable effectiveness and efficiency, and utilizes less coating powder, with the attendant advantages discussed above. Coating can be carried out at voltage levels that are significantly reduced from those heretofore employed for practical high-speed operation, thereby further enhancing safety. The nature of the coating can readily be controlled by the speed of the workpiece and the magnitude of the voltage applied; the deposit is highly tolerant of changes of workpiece position within the cloud of charged particles, and is virtually unaffected by normal fugitive electrical effects, such as noise and static. Production economy is maximized by the avoidance of significant waste during start-up and discontinuances of operation, and the coating unit is uncomplicated and relatively inexpensive to manufacture and operate.

Having thus described the invention, what is claimed is:

1. Electrostatic coating apparatus comprised of: chamber-defining structure; a generally cylindrical porous member disposed within the chamber of said structure and cooperatively forming therewith a surrounding plenum completely thereabout, said cylindrical member being adapted to permit gas flow therethrough between said plenum and the interior thereof; means for creating a helical flow of a gaseous suspension of particulate coating material, of generally tubular form, within and substantially coaxially with said cylindrical member; and means for electrostatically charging the particulate material of such a suspension, whereby a generally tubular cloud of electrostatically charged particulate material, flowing along a generally helical path, may be produced within said cylindrical member, and whereby a workpiece, moved along a travel path axially through said cylindrical member and maintained at an electrical potential effectively opposite to that of the particulate material, may be coated therewith.

2. The apparatus of claim 1 including a conduit for feeding particulate coating material to said helical flow creating means, said conduit having an outlet adjacent one end of said cylindrical member and being in gas flow communication with said plenum at a point spaced therefrom, so that gas introduced into said plenum may be used to promote movement of the particulate material through said conduit.

3. The apparatus of claim 2 wherein said helical flow-creating means comprises a vortex device adapted to receive a gas and discharge it within said cylindrical member adjacent said outlet of said conduit.

4. The apparatus of claim 1 wherein said helical flow-creating means includes structure communicating with the interior of said cylindrical member and adapted for connection to exhaust means for forcibly evacuating gas therefrom.

5. The apparatus of claim 1 wherein said chamber-defining structure has axially aligned openings adjacent the opposite ends of said cylindrical member to permit passage of a continuous length workpiece therethrough.

6. Electrostatic coating apparatus comprised of: chamber-defining structure; a generally cylindrical porous member disposed within the chamber of said structure and cooperatively forming therewith a surrounding plenum completely thereabout, said cylindrical member being adapted to permit gas flow therethrough between said plenum and the interior thereof over substantially its entire length and circumference; means for creating a helical flow of a gaseous suspension of particulate coating material, of generally tubular form, within and substantially coaxially with said cylindrical member; and means for electrostatically charging the particulate material of such a suspension, said charging means comprising at least one electrode member and means for supporting said electrode member within said plenum, said supporting means being rotatably mounted in said apparatus and adapted to permit said electrode member to move along a circular path about said cylindrical member; whereby a generally tubular cloud of electrostatically charged particulate material, flowing along a generally helical path, may be produced within said cylindrical member, and whereby a workpiece, moved along a travel path axially through said cylindrical member and maintained at an electrical potential effectively opposite to that of the particulate material, may be coated therewith.

7. The apparatus of claim 6 wherein said chamber-defining structure additionally includes means for admitting a gas into said plenum for ionization by contact with said electrode member, and wherein said supporting means includes a vane member, said gas-admitting means being adapted and disposed to direct a stream of gas flowing into said plenum against said vane member to effect rotation of said supporting means and thereby such circular path movement of said electrode member.

8. The apparatus of claim 7 wherein said charging means comprises a plurality of said electrode members, wherein said electrode members are elongated and extend generally parallel to the axis of said cylindrical member, and wherein said supporting means comprises a pair of axially spaced rings to which said electrode members are connected adjacent their opposite ends and at circumferentially spaced locations, said apparatus including circular track components on which said rings are rotatably mounted, at least one of said rings and the one of said track components on which it is mounted being made of an electrically conductive material, with said one track component being adapted for operative connection to a source of electrical power.

9. The apparatus of claim 8 wherein said rings provide said vane member.

10. The apparatus of claim 6 wherein said helical flow-creating means comprises a vortex device adapted to receive a gas and discharge it within said cylindrical member adjacent one end thereof.

11. The apparatus of claim 10 wherein said vortex device has an inlet in gas flow communication with said plenum, so that gas introduced thereinto may be used for such flow-creating effect.

12. The apparatus of claim 6 wherein said helical flow-creating means includes structure communicating with the interior of said cylindrical member and adapted for connection to exhaust means for forcibly evacuating gas therefrom.

13. The apparatus of claim 11 including a conduit for feeding particulate coating material to said helical flow-creating means, with an outlet adjacent the point of discharge of said vortex device.

14. The apparatus of claim 6 wherein said chamber-defining structure has axially aligned openings at the opposite ends of said cylindrical member to permit passage of a continuous length workpiece along said travel path therethrough.

15. Electrostatic coating apparatus comprised of: support structure; a generally cylindrical member having a substantially continuous inside surface, supported by said structure, said structure and cylindrical member being adapted to permit a workpiece to be moved along a travel path axially through said cylindrical member; means for creating, independently of a workpiece, a helical flow of a gaseous suspension of particulate material, in generally tubular form and moving over said inside surface of said cylindrical member; and means for electrostatically charging the particulate material of such a suspension, whereby a generally tubular cloud of electrostatically charged particulate material, flowing along a generally helical path, may be produced within said cylindrical member, and whereby a workpiece, so moved through said cylindrical member and maintained at an electrical potential effectively opposite to that of the particulate material, may be coated therewith.

16. In an electrostatic powder coating system, the combination including:

A. coating apparatus comprised of: chamber-defining structure; a generally cylindrical porous member disposed within the chamber of said structure and cooperatively forming therewith a surrounding plenum completely thereabout, said cylindrical member being adapted to permit gas flow therethrough between said plenum and the interior thereof; means for creating a helical flow of a gaseous suspension of particulate coating material, of generally tubular form, within and substantially coaxially with said cylindrical member; and means for electrostatically charging the particulate material of such a suspension, said chamber-defining structure having axially aligned openings at the opposite ends of said cylindrical member to permit passage of a workpiece along a travel path therethrough; and B. means for continuously conveying a workpiece along said travel path through said apparatus, whereby a generally tubular cloud of electrostatically charged particulate material, flowing along a generally helical path, may be produced within said cylindrical member, and whereby a workpiece, moved along said travel path and maintained at an electrical potential effectively opposite to that of the particulate material, may be coated therewith.

17. The system of claim 16 wherein said conveying means is adapetd to convey metal conductors of continuous length.

18. A method for producing a coating upon a workpiece, comprising the steps of:

A. creating a generally cylindrical volume of moving gas in which mass transfer is substantially limited to radial inward flow;

B. creating a helical flow of gas-suspended particles, so as to produce a generally tubular cloud of helically moving particles coaxially with and proximally within said cylindrical volume of gas, said cylindrical volume and said tubular cloud being created independently of a workpiece;

C. effecting electrostatic charging of said particles of said cloud; and

D. conveying a workpiece along a path substantially on the common axis of said cylindrical volume of gas and said cloud, and at an electrical potential that is effectively opposite to the charge on said charged particles, so as to electrostatically attract said charged particles from said cloud and produce a deposit thereof upon said workpiece.

19. The method of claim 18 wherein said helical flow is created by introducing a gas at one location along said path and by forcibly withdrawing it at a second location therealong spaced therefrom.

20. The method of claim 18 wherein said workpiece is a metal conductor of continuous length.

21. The method of claim 18 wherein said step of electrostatic charging is effected by use of an ionized gas, and wherein said ionized gas is produced by causing a gas to impinge upon an electrode component maintained at high electrical potential.

22. The method of claim 21 wherein said electrode component is mounted to rotate about said travel path and to be pneumatically driven, and wherein said method includes the additional step of causing a stream of gas to impinge upon the means by which said electrode component is mounted to drive the same and cause said component to rotate about said path.

23. The method of claim 22 wherein a single supply of gas is used to create said cylindrical volume of gas, for electrostatic charging of said particles, and also for driving of said electrode component mounting means.

24. The method of claim 18 wherein said high electrical potential has a value of about 20 to 30 kilovolts, and wherein said workpiece is maintained at ground potential.

* * * * *